US008044014B2

(12) United States Patent
Gerusz et al.

(10) Patent No.: US 8,044,014 B2
(45) Date of Patent: Oct. 25, 2011

(54) LIQUID AND STABLE OIL-IN-WATER OR WATER-IN-OIL EMULSION WITH A VEGETABLE OIL OR MINERAL OIL BASE

(75) Inventors: Roman Gerusz, Peronnas (FR); Antoine Vanlaer, Paris (FR)

(73) Assignee: Mexel Industries, Paris (FR)

( * ) Notice: Subject to any disclaimer, the term of this patent is extended or adjusted under 35 U.S.C. 154(b) by 19 days.

(21) Appl. No.: 12/609,740

(22) Filed: Oct. 30, 2009

(65) Prior Publication Data

US 2010/0113319 A1 May 6, 2010

(30) Foreign Application Priority Data

Oct. 31, 2008 (FR) ..... 08 57421

(51) Int. Cl.
*C11D 1/83* (2006.01)
*C11D 7/14* (2006.01)

(52) U.S. Cl. ..... 510/366; 510/240; 510/251; 510/417; 510/422; 510/427; 510/466; 510/486; 510/511

(58) Field of Classification Search ..... 510/240, 510/251, 366, 417, 422, 427, 466, 486, 511
See application file for complete search history.

(56) References Cited

U.S. PATENT DOCUMENTS

| | | | | |
|---|---|---|---|---|
| 6,468,952 | B1 * | 10/2002 | Reynolds | 510/203 |
| 2002/0172759 | A1 * | 11/2002 | LaFay et al. | 427/133 |
| 2003/0104019 | A1 * | 6/2003 | McCulloch et al. | 424/401 |
| 2003/0220446 | A1 * | 11/2003 | Faler et al. | 524/590 |
| 2005/0065056 | A1 * | 3/2005 | Cook et al. | 510/438 |
| 2006/0057170 | A1 * | 3/2006 | Guiramand | 424/401 |
| 2007/0108659 | A1 | 5/2007 | Althoff et al. | |
| 2009/0197790 | A1 * | 8/2009 | Sengupta et al. | 510/372 |
| 2010/0221206 | A1 * | 9/2010 | Giles et al. | 424/70.12 |
| 2010/0272765 | A1 * | 10/2010 | Ho O et al. | 424/401 |

FOREIGN PATENT DOCUMENTS

| | | |
|---|---|---|
| DE | 1444556 | 9/1969 |
| EP | 1785250 | 5/2007 |
| WO | 0216096 | 2/2002 |

OTHER PUBLICATIONS

Lagaly, G., et al., "Smectites as Colloidal Stabilizers of Emulsions Part I", Applied Clay Science, 1999, pp. 83-103, vol. 14, XP002533367.

Lagaly, G., et al., "Smectites as Colloidal Stabilizers of Emulsions Part II", Applied Clay Science, 1999, pp. 279-298, vol. 14, XP002533368.

French Search Report dated Jun. 23, 2009 from FR0857421.

* cited by examiner

*Primary Examiner* — Charles Boyer
(74) *Attorney, Agent, or Firm* — Young & Thompson

(57) ABSTRACT

A water-in-oil (w/o) or oil-in-water (o/w) emulsion consists of an oily phase that includes one or more oils of vegetable and/or mineral origin, and/or synthesis oils, at least one non-ionic and/or anionic emulsifying surfactant, and an aqueous phase that includes water, characterized in that the aqueous phase includes at least one phyllosilicate, so as to obtain a fluid and stable emulsion over time. The use, the process for preparation, a concentrate of the above-mentioned emulsion as well as its process for production are also described.

16 Claims, 3 Drawing Sheets

LIQUID AND STABLE OIL-IN-WATER OR WATER-IN-OIL EMULSION WITH A VEGETABLE OIL OR MINERAL OIL BASE

FIELD OF THE INVENTION

This invention relates to fluid and stable aqueous emulsions of one or more raw vegetable oils (i.e., purified vegetable oils, not modified chemically) and/or one or more previously refined or hydro-treated mineral oils.

This invention also relates to the process for manufacturing the above-mentioned emulsions.

This invention also relates to the use of these stable and fluid emulsions that are based on one or more raw vegetable oils and/or refined or hydro-treated mineral oils for stripping formwork and removing pieces of concrete, clays, ceramics, rubber or else plastics.

PRIOR ART

By definition, an emulsion is a mixture of two non-miscible substances that can be emulsified according to different formulations and different production techniques. Each substance is called a phase. In one emulsion, the phase in the form of micro-droplets is the discontinuous phase, while the phase that surrounds the micro-droplets is called the continuous phase. Thus, a water-in-oil (w/o) emulsion consists of an aqueous discontinuous phase that is dispersed into an oily continuous phase, and, conversely, an oil-in-water (o/w) emulsion consists of an oily discontinuous phase that is dispersed in an aqueous continuous phase.

Because of the chemical incompatibility of the two phases, as well as their difference in density (an oily phase that is lighter than water), it is necessary to make the emulsion stable over time. The formation of the emulsion and its stability depend on the thermodynamic laws. In particular, it is known that the reduction of the diameter of the droplets is a factor that is favorable to stability. This reduction of the diameter in contrast requires energy. The method for manufacturing emulsions is therefore an important parameter. In general for this purpose, stirring mechanisms with high shearing rates or high-pressure homogenizers are used.

To reduce the energy of creating the o/w or w/o interface, surfactants or emulsifiers that allow the reduction of this interfacial energy are also used.

However, despite the use of emulsifiers, sometimes the w/o or o/w emulsions that are obtained lack stability. This lack of stability is reflected by the appearance of a separation phenomenon between the phases.

There are actually three primary destabilization mechanisms: the creaming that corresponds to the rise of the least dense phase; the coalescence that corresponds to the breaking of the surfactant film that separates two droplets, and the flocculation that corresponds to the aggregation of several droplets.

To prevent these undesirable phenomena, it is often necessary in emulsions to resort to thickening agents. These thickening agents are actually able to limit, and even to stop, the internal movement of droplets in the continuous phase. However, this addition of thickeners limits the possible galenical forms of the cosmetic products and excludes in particular the very fluid compositions.

To obtain fine, fluid and stable o/w emulsions, ionic (cationic or anionic) polymers of the phthalate-sulfoisophthalate-glycol copolymer type marketed under the trademark Eastman AQ Polymer® of Eastman Chemical have been described as stabilizing, in particular in the document EP0864320.

The document WO 1995 031898 describes concentrated pesticide compositions that can be used in agriculture and that are designed to be emulsified with water just before use. So as to make the final formula viscous, silicic derivatives, such as precipitated or pyrogenated colloidal silicas, are added. As an accompanying thickening agent, products that are known to one skilled in the art are mentioned, such as mineral derivatives like silicates (attapulgite, bentonites, . . . ), magnesium aluminosilicates, organic derivatives such as cellulosic derivatives (cellulose ethers, carboxymethyl cellulose ethers, hydroxypropyl cellulose ethers, . . . ) or else polymers such as gum Arabic or xanthan gum. Thus, this document proposes mixing the oily compounds with water just before use.

For cosmetic creams or lotions, the document EP 0737508 proposes emulsions of hydrofluorocarbon compounds, such as 2-F-octyl ethyl hexanoate, as stabilizers.

For galenical forms in cosmetic and pharmaceutical fields, the document EP 0711539 proposes salts of salicylic acid derivatives, such as n-octanoyl-5-salicylic acid, as stabilizers of o/w emulsions.

In the construction field, civil engineering, concrete-removing agents are used to facilitate the stripping of formwork after the concrete hardens.

The conventional compositions are made either from aromatic petroleum derivatives (gas oil) or from solvent-containing recycling oils to lower the viscosity and to facilitate their application (in cold weather in particular) by spraying.

The use of such non-biodegradable and toxic compounds in general leads to a high health risk for the construction workers who have to spray the product, as well as to environmental pollution.

To reduce the viscosity of these compounds and to fluidize them, it has been proposed to use pure or modified solvent-containing vegetable oils. Despite improved biodegradability, these new demolding agents based on solvent-containing vegetable oils are inflammable and toxic, owing to the presence of their solvent. In addition, at the appearance of the concrete wall-facing after demolding, bubbling defects and superficial heterogeneities remain.

The document EP 1900702 describes a biodegradable demolding composition that contains an aqueous emulsion of a mineral oil or ester derivatives. The emulsion comprises an organic acid, an ester surfactant, such as monoglycerides of lower alkanoic acids, another ester of polyethylene glycol, an oleic acid, and an ether surfactant. The composition also comprises colloidal silica, whereby the colloidal silica is silicon oxide in a colloidal state.

As mentioned above, the prior tests for production of pure vegetable oil emulsions, such as the canola or soybean oil, from different emulsifying systems, thickening agents or else conventional stabilizers of organic type (xanthan gum . . . ) or minerals (silicas, bentonites, . . . ) have proven insufficient when the object in question was to obtain fluid emulsions, with a low viscosity and with a storage stability of 6 months to 1 year.

In addition, for each type of vegetable oil (canola, soybean, . . . ), owing to their different chemical compositions (variable levels of oleic, linoleic, and palmitic fatty acids), it has been necessary to modify emulsifier systems as well as the selection of the thickening agent for each formulation.

These problems led to numerous manufacturers of concrete removal agents renouncing the development of o/w or w/o emulsions that have low viscosity and that are ready for use starting from vegetable oils.

The document EP 1 785 250 describes an aqueous dispersion that is designed in particular for the molding of polyurethane that comprises water, anionic or non-ionic emulsifying agents (0.1 to 10%), an anti-agglomerating agent (0.5 to 40%) that is selected from among: soaps, oils, waxes and silicones, and talc or mica (0.1 to 10%).

The document WO 02/16096 describes a demolding agent that comprises soaps of organic acid amines, non-ionic emulsifying agents ("monoleate sorbitan") and phyllosilicates (talc $Mg_3Si_4O_{10}(OH)_2$; polygorskite: $Mg_5Si_8O_{20}(HO)_2(OH_2)_{4\cdot 4}H_2O$; or clays from the group of smectites) in a demineralized aqueous phase. The phyllosilicates that comprise magnesium silicate and/or aluminum are preferred.

The scientific publications "Smectite as Colloidal Stabilizers of Emulsions I" and "Smectite as Colloidal Stabilizers of Emulsions II" of G. Lagaly describe smectites that are used as a stabilizer of emulsions comprising surfactants, such as non-ionic surfactants. In particular, the second publication describes oil-in-water emulsions that are prepared by dispersing an aqueous phase that comprises bentonites ($Al_2O_34SiO_2H_2O$), montmorillonites (Na, $Ca)_{0.33}(Al, Mg)_2Si_4O_{10}(OH)_{2-n}H2O$) or hectorites ($Na_{0.3}(Mg, Li)_3Si_4O_{10}$ (F, $OH)_2$) in the paraffin oil that comprises emulsifying agents.

In conclusion, the prior art does not describe any liquid o/w or w/o emulsion at ambient temperature that is stable over time, i.e., for at least 6 months to 1 year.

The invention has as its object to propose a new w/o or o/w emulsion that avoids all or part of the above-mentioned drawbacks.

DESCRIPTION OF THE INVENTION

For this purpose, the invention relates to a water-in-oil (w/o) or oil-in-water (o/w) emulsion composed of an oily phase that comprises one or more oils of vegetable and/or mineral origin, and/or synthesis oils, at least one non-ionic and/or anionic emulsifying surfactant, and an aqueous phase that comprises water, characterized in that the aqueous phase comprises at least one phyllosilicate, so as to obtain a fluid and stable emulsion over time.

This applicant unexpectedly found that the addition of certain specific clays that come in lamina form and that belong more particularly to the family of phyllosilicates made it possible to easily stabilize the o/w or w/o emulsions that are based on vegetable oils and/or mineral oils and/or synthesis oils, while maintaining low viscosity regardless of the temperature. Thus, the vegetable/mineral/synthesis oil-based emulsions according to the invention have a fluidity that is sufficient to allow them to be easily applied at the worksite, using spraying devices, for example, or by premanufacturing by simple spraying on the walls of molds. In addition, these phyllosilicates make it possible to obtain a w/o or o/w emulsion that is homogeneous and stable over time (8 months to 1 year), which constitutes real progress relative to the emulsions that are currently on the market.

Owing to their mineral nature, the phyllosilicate-type clays are inert and compatible with most of the non-ionic, anionic, or amphoteric, standard emulsifying surfactants.

Preferably, the phyllosilicate corresponds to the formula below:

$$Na^{+}_{0.7}[(Si_8Mg_{5.5}Li_{0.3})O_{20}(OH)_4]^{-07}$$

Actually, it was found that the stabilizing effectiveness of the phyllosilicates was connected not only to their special crystallographic and chemical composition, but also to their overall ionic polarity that is negative after dispersion in the water. In particular, the stability is improved with a phyllosilicate that has an adequate electrical charge of 0.7 per mesh like the phyllosilicate of the formula below.

Consequently, owing to the crystallographic and ionic properties of the phyllosilicates, it is from now on possible to obtain emulsions starting from pure vegetable/mineral or synthesis oils that are fluid, stable over time, and have quick rheofluidification during the use of emulsions by spraying. In addition, contrary to the emulsions that contain standard organic thickeners such as xanthan, etc., the stabilization of the emulsions according to this invention is not affected by the temperature variations.

So as to control the quality of this type of phyllosilicates, it is preferable to obtain them by synthesis from components with pure and uniform bases. The laminae that are obtained by synthesis will preferably be ground to obtain a powdered phyllosilicate product that is dry and easy to store.

Furthermore, at the level of the process for preparation of emulsions, this powdered phyllosilicate product can be mixed with water (preferably deionized or softened) and can be put in advance into the form of a gel or a fluid sol. For example, a peptizing dispersing agent of the polyphosphate type can be used so as to produce the gel or the fluid sol.

Advantageously, the vegetable oil or oils are raw, and the mineral oils are refined or hydrotreated.

Raw vegetable oil is defined as the vegetable oil that has been purified and is not modified chemically. An oil is said to be purified when it has been at least filtered in advance.

According to a characteristic of the invention, the water from the aqueous phase is deionized or softened.

Preferably, the non-ionic and/or anionic emulsifying surfactant is liquid at ambient temperature (20-25° C.), biodegradable, and made on a vegetable base.

In particular, the non-ionic emulsifying surfactant is selected from among an ethoxylated fatty alcohol, an ester from fatty acids and polyols, a sorbitan ester, a polyethoxylated sorbitan ester, an ethoxylated ricin oil, an alkoxylated fatty alcohol, a polyglucoside alkyl, or a polymer surfactant, and the anionic emulsifying surfactant is selected from among an alkaline salt of fatty acids and resin acids, an alkyl aryl sulfonate, an alkylsulfosuccinate, an alkyl sulfate, an alkyl ether sulfate, an amide ether sulfate, a derivative of sulfonic dodecylbenzene, or amide ether sulfate.

Advantageously, the oil or oils represent 10% to 80% by weight; the emulsifying surfactant represents 0.5% to 20% by weight; the water represents 10% to 90% by weight; and the phyllosilicate represents 0.01% to 20% by weight, relative to the total weight of the water-in-oil (w/o) or oil-in-water (o/w) emulsion.

Even more advantageously, the oil or oils represent 20% to 50% by weight; the emulsifying surfactant represents 2% to 8% by weight; the water represents 30% to 80% by weight; and the phyllosilicate represents 0.1% to 5% by weight, relative to the total weight of the water-in-oil (w/o) or oil-in-water (o/w) emulsion.

Preferably, the oily phase comprises at least one oleophilic adjuvant.

It is possible to add oleophilic adjuvants such as anti-foaming agents, anti-gels, anti-corrosion agents, anti-oxidation agents, colored tracers, etc., to the oily phase and at a low dose, for example on the order of 0.01% to 2% by weight relative to the total weight of the emulsion.

Advantageously, the aqueous phase comprises a hydrophilic adjuvant.

Likewise, it is possible to add hydrophilic adjuvants, such as biocidal protection agents, dispersing agents, chelating agents, antioxidants, viscosity reducing agents, and thickening agents, etc., to the aqueous phase and also at a low dose (on the order of 0.01% to 2% by weight relative to the total weight of the emulsion).

The adjuvants that are used are preferably biodegradable and liquid at ambient temperature (20-25° C.).

According to one characteristic of the invention:

the oil of vegetable origin is selected from among canola oil, soybean oil, sunflower oil, olive oil, palm oil, peanut oil, jojoba oil, copra oil or one of their mixtures;

the oil of mineral origin is selected from among paraffin oil, isoparaffin oil, hydrotreated naphthenic oil, polyisobutene or one of their mixtures;

the synthesis oil is selected from among the fatty acid esters such as soybean or canola methyl ester or one of their mixtures.

These oils are preferably liquid at ambient temperature (20-25° C.).

The emulsions that are produced according to the invention can be classified as biodegradable (and even totally biodegradable based on the adjuvant that is used), non-toxic, non-flammable, and non-polluting for the environment.

This invention consequently proposes producing low-viscosity emulsions without having recourse to solvents or to volatile organic compounds (VOC).

This invention also has as its object a concentrate of a water-in-oil (w/o) emulsion or an oil-in-water (o/w) emulsion that comprises at least one or more oils of vegetable and/or mineral origin, and/or a synthesis oil, and a non-ionic and/or anionic emulsifying surfactant and at least one phyllosilicate in powdered form and/or dissolved in advance in a minimum amount of water so as to obtain a gel or a fluid sol, characterized in that its dilution makes it possible to obtain a w/o or o/w emulsion according to the characteristics of the water-in-oil (w/o) emulsion or the oil-in-water (o/w) emulsion as described above.

The concentrate can also comprise the other components that fall within the composition of the w/o or o/w emulsion that is ready for use, such as the oleophilic and hydrophilic adjuvants as described above.

Since the emulsion according to this invention is in concentrate form, it offers the advantage of being more easily transportable and therefore of reducing the long-distance shipping costs.

This invention also has the object of using the water-in-oil (w/o) emulsion or the oil-in-water (o/w) emulsion according to one of the characteristics above as an agent for demolding and/or stripping formwork.

In particular, this invention relates to the use of the water-in-oil (w/o) emulsion or the oil-in-water (o/w) emulsion as described above for demolding pieces of concrete and/or stripping formwork therefrom.

The emulsions of this invention can also be used for removing all other materials such as pieces of clay, ceramic, rubber or plastic.

This invention also has as its object a process for preparation of a water-in-oil (w/o) emulsion or oil-in-water (o/w) emulsion as described above, comprising the stages that consist in:

(i) preparing the oily phase by mixing the compounds that are part of the oily phase such as at least one or more oils of vegetable and/or mineral origin, and/or synthesis oils, and a non-ionic and/or anionic emulsifying surfactant, (ii) preparing the aqueous phase by mixing the compounds that are part of the aqueous phase, such as at least water and phyllosilicate, (iii) mixing the oily phase and the aqueous phase continuously or intermittently in a dispersing machine.

A dispersing machine is a device that makes it possible to mix, shear, and effectively emulsify emulsions, so as to obtain emulsions with fine globules.

The process for preparation of emulsions according to the invention thus offers the advantages of being simple and economical. Actually, it is unnecessary, for example, to produce phase inversions that require heating the oil and water phases at high temperature (around 90° C.) and therefore increasing manufacturing costs.

This is why the mixing of phases is done at ambient temperature. There is no phase inversion.

In an even more particular manner, the mixing of the phases is done at approximately 20 to 25° C.

As mentioned above, the phyllosilicate(s) can be packaged in advance in the form of a gel or a fluid sol.

This invention also relates to a process for preparation of a concentrate of a water-in-oil or oil-in-water emulsion according to the characteristic above, characterized in that it comprises the stages that consist in:

(i) preparing a first mixture based on at least one phyllosilicate in powdered form and/or based on at least one phyllosilicate that was dissolved in advance in a minimum amount of water so as to obtain a gel or a fluid sol, (ii) mixing at least one or more oils of vegetable and/or mineral origin and/or synthesis oils with a non-ionic and/or anionic emulsifying surfactant so as to form an oily phase, (iii) mixing in a dispersing machine the mixture that is obtained in stage (i) with the one that is obtained in stage (ii).

Stage (iii) above can be carried out continuously or intermittently, whereby the continuous mixing is preferred so as to obtain a more homogeneous concentrate.

Examples of a Preparation Method and Emulsion Compositions According to the Invention and Comparative Test To make the object of the invention better understood, a device that can make it possible to obtain emulsions according to the invention will be described, on the one hand, and, on the other hand, embodiments of said emulsions will be described. Finally, comparative tests of removing concrete will be presented. The following descriptions are provided by way of purely illustrative and non-limiting examples; the drawing of the emulsifying device is a diagrammatic drawing that is intended only to illustrate the principle of the device that is used for the production of the examples of emulsions according to the invention.

Figure 2:
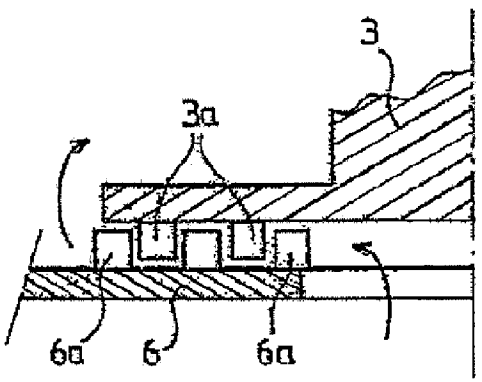
FIG. 2 is a partial and diagrammatic representation of the palettes of the rotor and stator, palettes whose cooperation allows a high shearing rate, and, consequently, a sufficiently fine emulsion to be obtained to fall within the scope of this invention.
Figure 1:
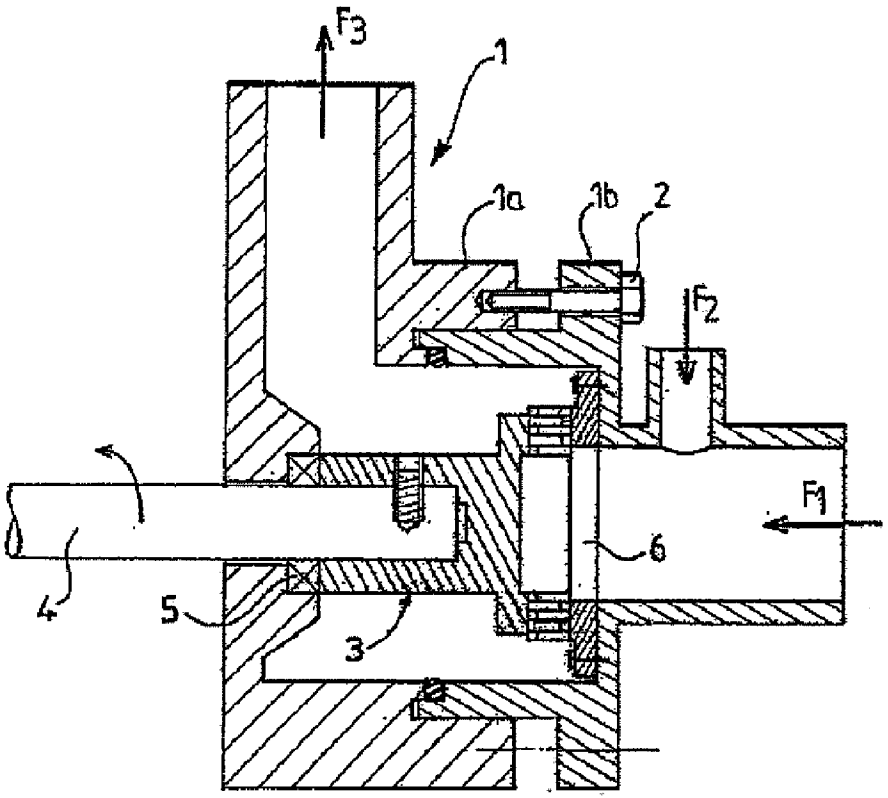
FIG. 1 represents, in axial cutaway, an emulsifying device that makes it possible to obtain the compositions according to the invention.
Figure 4:
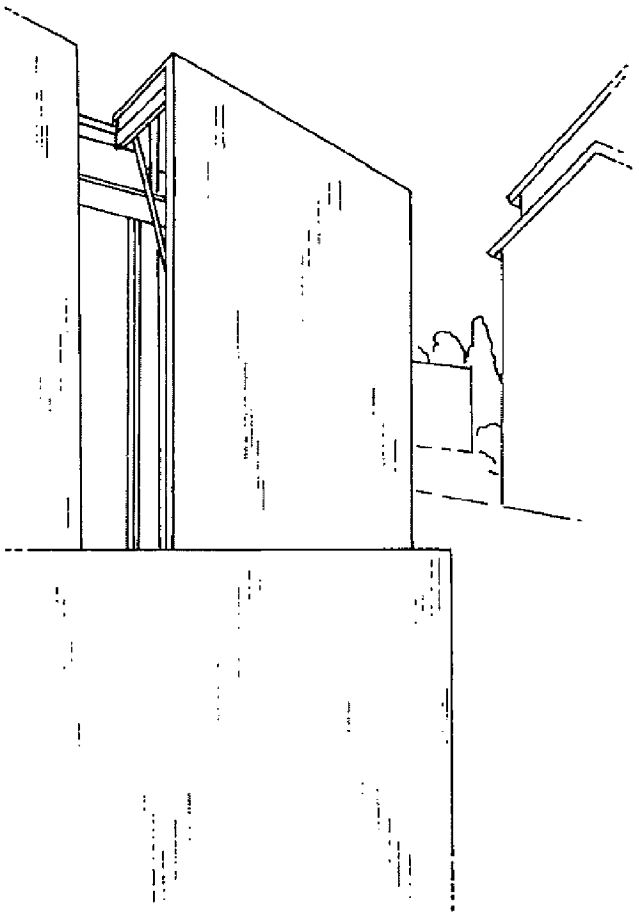
FIG. 4 is a photograph that shows the condition of the surface of a mold after stripping concrete formwork by using the emulsion according to this invention.
Figure 3:
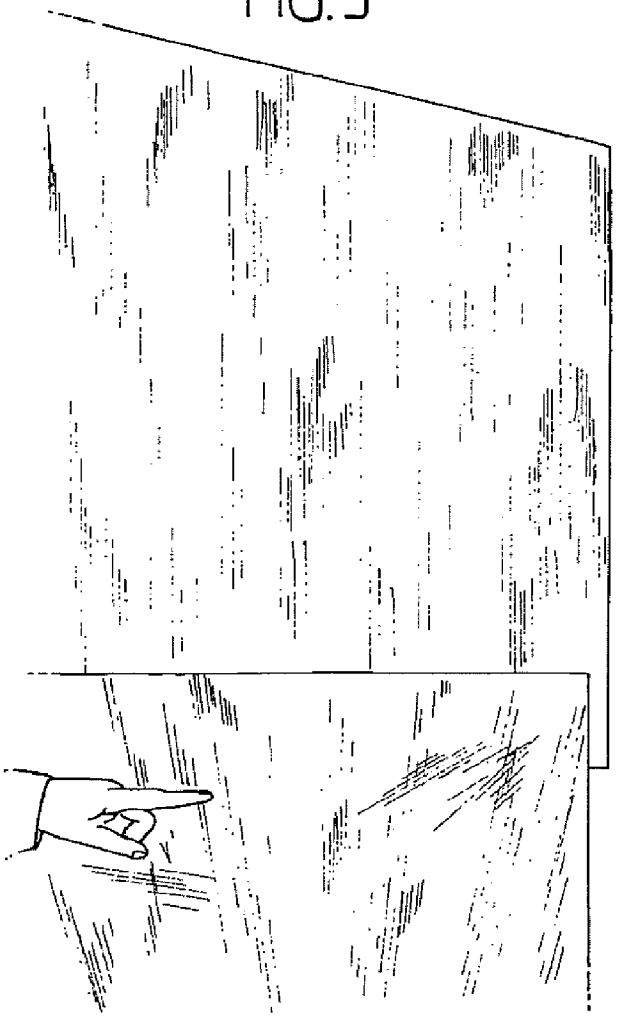
FIG. 3 is a photograph that shows the condition of the surface of a mold after stripping concrete formwork by using a composition for concrete removal according to the prior art, called composition X.

Although the emulsifying device that is shown in FIGS. 1 and 2 is not part of the invention, a quick description will be provided below. The stator of the emulsifier was referred to in its entirety as 1. The stator 1 consists essentially of two parts 1*a* and 1*b* that are assembled with one another by means of bolts 2. The stator 1 receives a rotor that is referred to in its entirety as 3, whereby the rotor 3 is driven in rotation relative to the stator by a shaft 4. The rotation of the rotor 3 and the shaft 4 relative to the stator 1 is made possible by a system of sealed bearings 5.

The part 1*b* of the stator comprises the intake lines of the products that are designed to constitute the emulsion: for example, the aqueous phase is sent along the arrow F1, and the oily phase of the emulsion is sent along the arrow F2 (or vice versa). The whole unit penetrates the stator that comprises a circular blade carrier 6 that is attached by screws to the part 1*b* of the stator, whereby the blades 6*a* of the blade carrier 6 are radial and directed from the side of the rotor 3, i.e., from the side that is opposite the intake of the products to be emulsified. The end of the rotor 3 that is opposite the blade carrier 6 has the form of a plate that carries radial blades 3*a*. The blades 3*a* and 6*a* are arranged along concentric circles, whereby the blades 3*a* are located in the circular annular spaces that exist between two successive circles of blades 6*a*.

The products that are to be emulsified enter the zone between the blade carrier 6 and the rotor 3 by a central circular opening of the blade carrier 6, pass centrifugally through the space that is between the blade carrier 6 and the rotor 3, and are ejected at the periphery of said space to be able to be evacuated beyond the device along arrow F3. It is clear that the flow of entering products undergoes successive shearing between the stationary blades 6*a* and the blades 3*a* that are driven in rotation by the shaft 4. In a known way, the thinness of the emulsion that is obtained is based on, in particular, the number of concentric circles of blades 3*a* and 6*a*, of the radial space between the edges of said blades, and the speed of rotation of the shaft 4. In other words, for a given device and a given flow rate, the characteristics of the emulsion that is obtained are a function of the speed of rotation of the rotor.

Preferably, a speed of rotation on the order of 6,500 rpm is suitable for obtaining fluid emulsions according to this invention.

The process as described above makes it possible to obtain homogeneous and uniform emulsions continuously; however, it is also possible to produce the emulsions according to the invention intermittently (process by lots).

Now, examples of emulsion according to the invention that are purely illustrative and nonlimiting of the scope of the invention will be described.

Example 1

Emulsion Based on Pure Canola Oil and Biodegradable Components and Adjuvants

| Composition | % (by Weight) Relative to the Total Weight of the Emulsion |
|---|---|
| Oily Phase | |
| Raw canola oil: 350 kg | 34.99% |
| Fatty acid esters (polyethylene): 55 kg | 5.5% |
| Ethoxylated vegetable-based emulsifying agents: 25 kg | 2.5% |
| Aqueous Phase | |
| Water: 564 kg | 56.38% |
| Ionized phyllosilicate-type clay that corresponds to, for example, the formula $Na^{+}_{0.7}[(Si_8Mg_{5.5}Li_{0.3})O_{20}(OH)_4]^{-0.7}$: 6 kg | 0.60% |
| Preservative: 0.4 kg (dispersed in water) | 0.04% |

Example 2

Emulsion Based on Pure Soybean Oil and Biodegradable Components and Adjuvants

| Composition | % (by Weight) Relative to the Total Weight of the Emulsion |
|---|---|
| Oily Phase | |
| Raw soybean oil: 350 kg | 34.99% |
| Alkoxylated fatty alcohols: 50 kg | 5.50% |
| Ethoxylated vegetable-based emulsifying agents: 15 kg | 1.50% |
| Aqueous Phase | |
| Water: 579 kg | 57.88% |
| Ionized phyllosilicate-type clay that corresponds to, for example, the formula $Na^{+}_{0.7}[(Si_8Mg_{5.5}Li_{0.3})O_{20}(OH)_4]^{-0.7}$: 6 kg | 0.60% |
| Preservative: 0.4 kg (dispersed in water) | 0.04% |

Comparative tests of removing concrete at external building sites between an emulsion according to this invention and a composition for concrete removal according to the prior art (composition X) will be presented below.

For these tests, the emulsion according to Example 1 has been reproduced.

The composition X according to the prior art is a solvent-containing mineral oil that is harmful and inflammable according to the safety label.

The emulsion according to the invention as well as the composition X have been sprayed on metal molds (it is also possible to do it on the wood) under a minimum pressure of 6 bar using a sprayer. With the composition according to Example 1, the presence of a uniform and stable oil film deposited over the entire surface is noted.

Then, the molds are allowed to dry in the open air for about one hour (until there is no water).

Molding is then carried out including one face with the emulsion according to the invention (Example 1) and the other with the composition X, according to the known practice of one skilled in the art.

Figure 6:
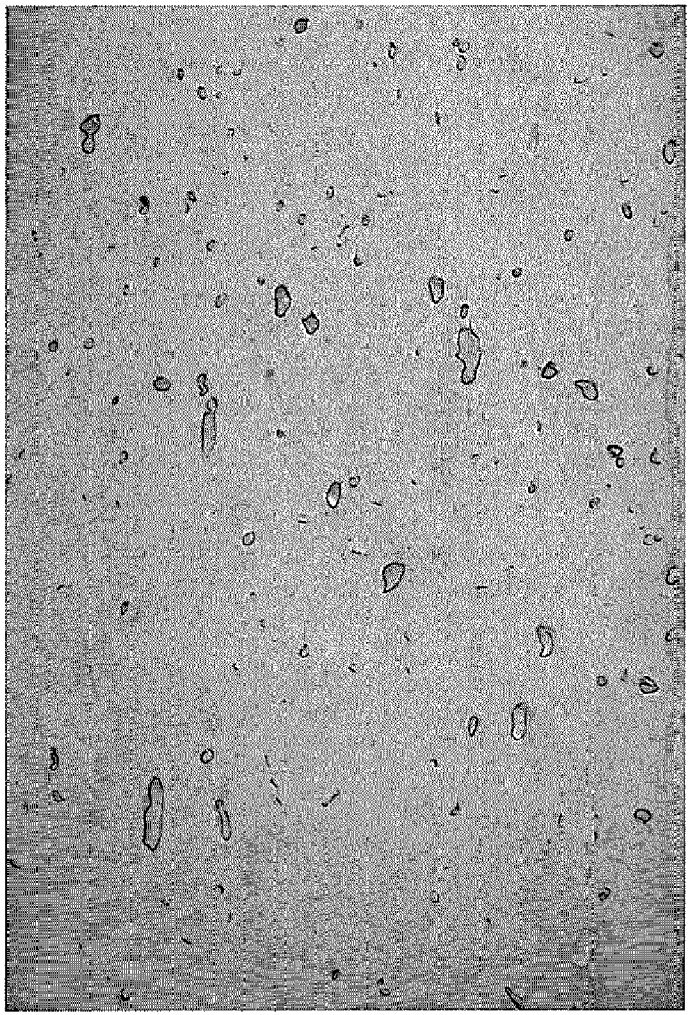
FIG. 6 is a photograph that shows the finishing of the concrete after demolding when the emulsion according to this invention has been used as a demolding agent.
Figure 5:
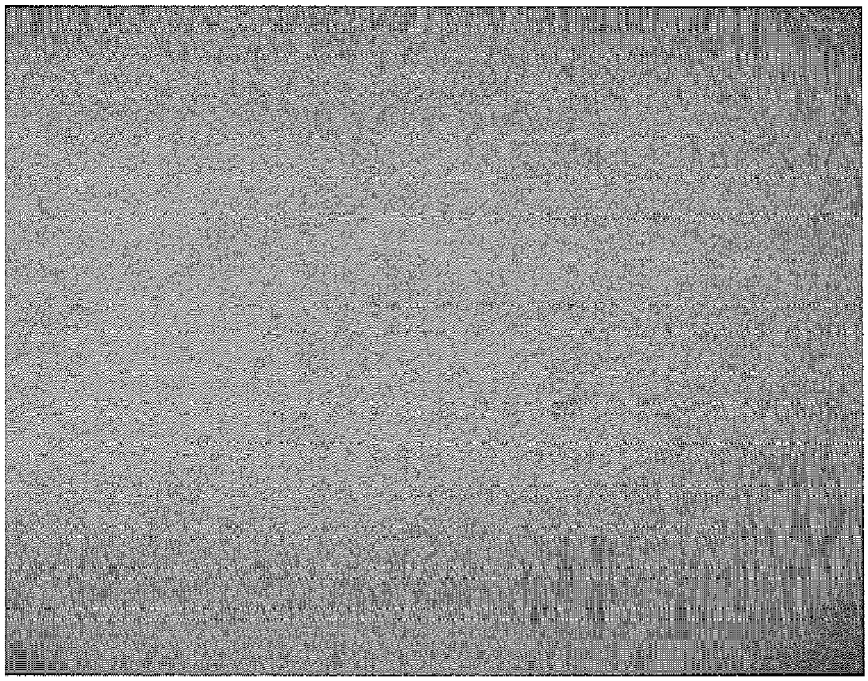
FIG. 5 is a photograph that shows the finishing of the concrete after demolding when the composition X has been used as a demolding agent.

Next, demolding is carried out and, as illustrated in the photographs 5 and 6, it is seen that the finished concrete is better when the emulsion according to Example 1 of the invention is used than with the composition X. Actually, when the wall facing of the concrete is removed with the composition X of the prior art, the surface of the concrete comprises bubbles (FIG. 5). It will consequently be necessary to initiate an additional leveling stage so that the surface of the concrete is uniform. Then, when the concrete is removed with the emulsion of Example 1 (FIG. 6), the finishing of the concrete is of good quality, and there is an absence (or quasi-absence) of bubbling; in this case, the leveling therefore is unnecessary. In addition, when an emulsion according to Example 1 is used as a demolding agent, it is noted that the clogging of the surfaces of the mold is minimized relative to the clogging of the mold when the composition X is used as a demolding agent.

Consequently, the emulsions according to the invention, stabilized by one or more phyllosilicates, have proven to have better performance levels than the demolding oils that are currently on the market.

Although the invention has been described in relation to a particular embodiment, it is quite obvious that it is in no way limited and that it comprises all of the technical equivalents of the means that are described as well as their combinations if the latter fall within the scope of the invention.

The invention claimed is:

1. A method of using a water-in-oil (w/o) or oil-in-water (o/w) emulsion as an agent for demolding and/or stripping formwork, comprising:

demolding and/or stripping formwork with a water-in-oil (w/o) or oil-in-water (o/w) emulsion that consists of:

an oily phase that comprises one or more oils of vegetable and/or mineral origin, and/or synthesis oils, at least one non-ionic and/or anionic emulsifying surfactant, and an aqueous phase that comprises water, whereby the aqueous phase comprises at least one phyllosilicate, so as to obtain a fluid and stable emulsion over time, characterized in that the phyllosilicate corresponds to the formula below:

$$Na^{+}_{0.7}[(Si_8Mg_{5.5}Li_{0.3})O_{20}(OH)_4]^{-07}.$$

2. The method of using according to claim 1, wherein the water-in-oil (w/o) or oil-in-water (o/w) emulsion removes pieces of concrete and/or stripping formwork therefrom.

3. The method according to claim 1, wherein the vegetable and/or mineral oil(s) are raw or purified and chemically non-modified.

4. The method according to claim 1, wherein the water of the aqueous phase is deionized or softened.

5. The method according to claim 1, wherein the non-ionic and/or anionic emulsifying surfactant is liquid at ambient temperature, biodegradable, and made on a vegetable base.

6. The method according to claim 5, wherein, the non-ionic emulsifying surfactant is selected from the group consisting of an ethoxylated fatty alcohol, an ester of fatty acids and polyols, a sorbitan ester, a polyethoxylated sorbitan ester, an ethyloxyated ricin oil, an alkoxylated fatty alcohol, a polyglucoside alkyl, and polymeric surfactant; and the anionic emulsifying surfactant is selected from the group consisting of an alkaline salt of fatty and resinic acids, an alkylaryl sulfonate, an alkylsulfosuccinate, an alkyl sulfate, an alkyl ether sulfate, an amide ether sulfate, and a derivative of sulfonic dodecylbenzene.

7. The method according to claim 1, wherein, relative to the total weight of the water-in-oil (w/o) or oil-in-water (o/w) emulsion, the oil or oils represent 10% to 80% by weight; the emulsifying surfactant represents 0.5% to 20% by weight; the water represents 10% to 90% by weight; and the phyllosilicate represents 0.1% to 20% by weight.

8. The method according to claim 1, wherein relative to the total weight of the water-in-oil (w/o) or oil-in-water (o/w) emulsion, the oil or oils represent 20% to 40% by weight; the emulsifying surfactant represents 2% to 8% by weight; the water represents 30% to 80% by weight; and the phyllosilicate represents 0.1% to 5% by weight.

9. The method according to claim 1, wherein the oily phase comprises at least one oleophilic adjuvant.

10. The method according to claim 1, wherein the aqueous phase comprises a hydrophilic adjuvant.

11. The method according to claim 1, wherein:

the oil of vegetable origin is selected from the group consisting of canola oil, soybean oil, sunflower oil, olive oil, palm oil, peanut oil, jojoba oil, copra oil and mixtures thereof;

the oil of mineral origin is selected from the group consisting of paraffin oil, isoparaffin oil, hydrotreated naphthenic oil, polyisobutene and mixtures thereof;

the synthesis oil is selected from fatty acid esters.

12. The method according to claim 1, wherein the emulsion comprises at least one or more oils of vegetable and/or mineral origin, and/or synthesis oils and a non-ionic and/or anionic emulsifying surfactant, and a phyllosilicate of formula $Na^{+}_{0.7}[(Si_8Mg_{5.5}Li_{0.3})O_{20}(OH)_4]^{-07}$ dissolved in advance in a minimum amount of water so as to obtain a gel or a fluid sol, wherein dilution of the gel or fluid sol makes it possible to obtain the w/o or o/w emulsion.

13. The method according to claim 1, wherein the emulsion is prepared by:

(i)preparing the oily phase by mixing the compounds that are part of the oily phase: at least one or more oils of vegetable and/or mineral origin, and/or synthesis oils, and a non-ionic and/or anionic emulsifying surfactant, (ii) preparing the aqueous phase by mixing the compounds that are part of the aqueous phase: at least water and phyllosilicate, and (iii) mixing the oily phase and the aqueous phase continuously or intermittently in a dispersing machine.

14. The method according to claim 13, wherein the mixing of the phases is carried out at ambient temperature.

15. The method according to claim 14, wherein the mixing of the phases is done at approximately 20 to 25° C.

16. The method according to claim 13, wherein the emulsion is prepared by:

(i) dissolving the phyllosilicate in a minimum amount of water so as to form a gel or a fluid sol, (ii) mixing at least one or more oils of vegetable and/or mineral origin, and/or synthesis oils, and a non-ionic and/or anionic emulsifying surfactant of the oily phase, and (iii) mixing the mixture that is obtained in stage (i) with the one that is obtained in stage (ii).

* * * * *